US006763661B2

(12) United States Patent
Tabor et al.

(10) Patent No.: US 6,763,661 B2
(45) Date of Patent: Jul. 20, 2004

(54) APPARATUS AND METHOD FOR PROVIDING VIBRATION TO AN APPENDAGE OF A WORK VEHICLE

(75) Inventors: Keith A. Tabor, Richfield, WI (US); Joseph L. Pfaff, Wauwatosa, WI (US)

(73) Assignee: Husco International, Inc., Waukesha, WI (US)

( * ) Notice: Subject to any disclaimer, the term of this patent is extended or adjusted under 35 U.S.C. 154(b) by 0 days.

(21) Appl. No.: 10/141,144

(22) Filed: May 7, 2002

(65) Prior Publication Data

US 2003/0209134 A1 Nov. 13, 2003

(51) Int. Cl.[7] ..... F01C 25/08
(52) U.S. Cl. ..... 60/327; 91/275
(58) Field of Search ..... 91/275, 459, 440; 60/327

(56) References Cited

U.S. PATENT DOCUMENTS

| | | | | |
|---|---|---|---|---|
| 3,916,768 A | | 11/1975 | Martin | |
| 4,537,556 A | * | 8/1985 | Tharp | 414/725 |
| 4,590,763 A | | 5/1986 | Augoyard et al. | |
| 4,715,265 A | * | 12/1987 | Graul et al. | 91/170 R |
| 5,160,034 A | * | 11/1992 | Potter | 209/38 |
| 5,224,033 A | * | 6/1993 | Nakamura et al. | 700/65 |
| 5,287,699 A | * | 2/1994 | Takamura et al. | 60/327 |
| 5,682,742 A | * | 11/1997 | Sato et al. | 60/327 |

FOREIGN PATENT DOCUMENTS

| | | |
|---|---|---|
| DE | 1 634 708 | 7/1970 |
| DE | 1 957 469 | 5/1971 |
| DE | 2 108 776 | 10/1972 |
| DE | 37 42 198 A | 6/1989 |
| EP | 0 511 383 A1 | 11/1992 |
| EP | 0 809 737 B1 | 12/1997 |

* cited by examiner

*Primary Examiner*—Thomas E. Lazo
(74) *Attorney, Agent, or Firm*—Quarles & Brady LLP

(57) ABSTRACT

An apparatus and method for creating vibration of an appendage of a work vehicle is disclosed. The apparatus includes a hydraulic cylinder, first and second valve assemblies, and a control element. The hydraulic cylinder is coupled between a first portion of the work vehicle and the appendage and includes a first chamber, a second chamber, and a piston. The first and second valve assemblies respectively govern whether hydraulic fluid is provided from a pump to, or to a tank from, the first and second chambers. The control element automatically causes a status of the second valve assembly to repeatedly alternate with time so that the vibration occurs at the piston and is in turn provided to the appendage.

26 Claims, 4 Drawing Sheets

APPARATUS AND METHOD FOR PROVIDING VIBRATION TO AN APPENDAGE OF A WORK VEHICLE

FIELD OF THE INVENTION

The present invention relates to hydraulic systems for work vehicles, and more particularly to work vehicles having appendages such as boom assemblies with bucket portions or other movable elements.

BACKGROUND OF THE INVENTION

Various work vehicles such as construction work vehicles (e.g., loader-backhoes) include movable appendages such as boom assemblies that can be used to scoop up or otherwise move material such as soil, sand and gravel. Such boom assemblies often include multiple segments that are movable relative to one another, and the boom assemblies in particular typically include buckets or other movable elements at the far ends of the boom assemblies away from the vehicles. These end elements of the boom assemblies are typically the portions of the boom assemblies that come into direct contact with the material to be scooped up or moved.

In various circumstances, the material that is being scooped up or otherwise moved by the boom assembly of a work vehicle has a gummy or otherwise adherent consistency. Such materials can include various forms of clay, for example. In particular, the consistency of the material is such that, as the end element of the boom assembly encounters the material, a portion of the material tends to adhere to the end element. Further because of the material's consistency, the material does not tend to fall off or otherwise become dislodged from the portion of the boom assembly to which it is adhering. Consequently, some of the material can become attached to the boom assembly during a digging cycle or job and remain attached during the digging cycle/job, such that not all of the material in the boom assembly is dumped out after each digging cycle/job.

Continued adhering of the material to the end element can be undesirable for a variety of reasons. First, the adhering of material to the end element can reduce the volume within the end element and consequently reduce the amount of material that can be picked up and moved by the end element in a given amount of time. Also, because the material is attached to the end element, the work vehicle can appear to be unsightly and uncleanly. Further, in certain circumstances, it can be unsuitable to use the bucket or other end element of the work vehicle to move other materials as long as the first material is still adhering to the end element. Thus, it can become necessary to remove the adhering materials from the end element by way of a separate operation after usage of the work vehicle.

Another problem encountered by work vehicles with boom assemblies is that the end elements can have difficulty in initially plowing or otherwise moving through the material that is to be scooped up or otherwise moved. This is particularly true in the case of hard materials such as black-top or frozen or frosted dirt. It also is the case where the material has either a gummy or adherent consistency, or where the material has been compacted under pressure such that it is difficult to pierce.

It is possible to operate conventional construction work vehicles in such a manner as to address these problems. In a conventional construction work vehicle, the position of the bucket or other end element is typically controlled by one or more hydraulic cylinders that each have head and rod chambers. The provision of hydraulic fluid from a pump toward a cylinder, as well as the allowing of hydraulic fluid to exit the cylinder toward a tank, are in turn determined by a valve. An operator can rapidly switch the position of the valve so that, at certain times, hydraulic fluid pressure from the pump is directed toward the head chamber while hydraulic fluid is allowed to exit the rod chamber toward the tank and, at alternating times, hydraulic fluid pressure from the pump is directed toward the rod chamber while hydraulic fluid is allowed to exit the head chamber toward the tank.

By alternating the status of the valve and consequently the hydraulic fluid pressure exerted at the cylinder, the bucket or other end element experiences a changing force that can result in a vibrational movement of the end element. This vibrational movement can dislodge materials that are adhering to the end element. Also, the vibrational movement can facilitate plowing or other movement of the bucket or other end element through material that is difficult to pierce through, since the vibrational movement tends to cause the material to break apart.

Despite the effectiveness of this conventional operation for creating vibration of the bucket or other end element, this operation has certain disadvantages. First, to obtain this vibration in conventional construction work vehicles, the operator must repeatedly switch the position of the valve. More specifically, the operation typically requires repeated switching of the position or statuses of one or more valves associated with the hydraulic cylinder(s) so that, at certain times, the valve(s) couple the pump to the head chamber of the cylinder(s) and the tank to the rod chamber of the cylinder(s), and at alternating times, the valve(s) couple the pump to the rod chamber of the cylinder(s) and the tank to the head chamber of the cylinder(s). This manual switching operation can become arduous since, for example, it can require repeated moving of a lever on the part of the operator (in the case where spool valves are employed).

Second, in certain circumstances, the bucket or other end element will undesirably tend to have an overall movement in a particular direction as it is being vibrated, rather than maintain its original or nominal position. This can occur because the operator is unable to consistently vary the pressures applied back and forth to the bucket so that the bucket maintains its original position. That is, the operator in some situations will tend to apply pressure in one direction too long during vibration of the bucket, which can tend to move the bucket away from its original position.

This problem can be exacerbated when the bucket or other end element is carrying a load or is otherwise experiencing a force from an outside source, which can include a force provided by the material through which the end element is attempting to plow or move. In such circumstances, it can be difficult for the operator to vary the position of the valve in a way that counteracts the influence of these forces such that the original, nominal bucket position is maintained. Consequently, as the positions of the valve(s) are repeatedly switched, the end element may move downward under the force of gravity, move away from the material through which the end element is attempting to move, or otherwise move away from its original position.

Such movement of the bucket or other end element can be a problem in a number of situations. For example, when the bucket is being operated in close proximity to other machinery, such as a dump truck, it can be a nuisance for the operator to have to repeatedly align the bucket to its original position when vibration of the bucket moves the bucket away from that original position. Also, movement of the bucket or other end element away from the material through which the end element is attempting to move can be counterproductive in that it reduces the ability of the end element to cut through the material.

Additionally, while movement of the bucket or other end element away from its original position is undesirable in many circumstances, there are also circumstances in which it is desired that the element experience an overall movement in a particular direction as it is vibrating. For example, this can be the case when the bucket is being used to loosen or break through hard materials along the ground, such as black-top. In these circumstances, it can again be difficult for an operator to manually perform the vibration operation in the desired manner. However, in this case, the difficulty arises because it is difficult for the operator to manually vary the position of the valve in a manner whereby the resulting amount of movement of the bucket in one direction consistently exceeds the amount of movement in the other.

A third disadvantage associated with the conventional ways of creating vibration of the bucket or other end element is that, while the rapid switching of the valves does produce some vibration, it is difficult to obtain large amounts of vibration, even when the hydraulic fluid pressure provided by the pump is quite large. Because the hydraulic fluid pressure is typically provided from the pump to the hydraulic cylinder by long rubber pump lines that run the length of the boom assembly and are not completely rigid, there is a significant amount of hydraulic capacitance that exists between the pump and the hydraulic cylinder. This hydraulic capacitance limits the vibrational effects that occur at the hydraulic cylinder as a result of the switching on and off of the hydraulic pressure from the pump (and the switching off and on of the coupling of the hydraulic cylinder to the tank).

Because of these disadvantages associated with the conventional manner of creating vibration at the buckets or other end elements of boom assemblies of construction work vehicles, it would therefore be desirable if a new system was developed for implementation on a construction work vehicle (or other work vehicle) that made it possible to create vibration at the bucket or other end element of the vehicle's boom assembly (or to create vibration at another appendage of the work vehicle.) It would be particularly advantageous if the new system could be operated to easily remove material that is adhering to the end element of the boom assembly. It would additionally be desirable if such a system also could be employed to enable the end portion of the boom assembly to more easily plow or otherwise move through material of an adherent or compacted nature.

It would further be desirable if such a system could be cost-effectively implemented on existing designs of construction work vehicles (or other work vehicles). It would also be desirable if such a system could be operated without significant manual control or exertion on the part of the operator of the construction work vehicle. It would additionally be advantageous if the system could operate to control the vibration of the end element so that, depending upon the circumstance, the vibration either would not move the end element away from its original, nominal position or, alternatively, the vibration would move the overall position of the end element in a particular desired direction. It would additionally be advantageous if the system's ability to provide vibration was not significantly limited by capacitance in the hydraulic lines coupling the pump and tank with the hydraulic cylinder.

SUMMARY OF THE INVENTION

The present inventors have discovered that it is possible to cause vibration to occur in a bucket or other end element of a boom assembly of a construction work vehicle by repeatedly switching the positions/statuses of only one pair of valves that control the flow of hydraulic fluid to and from only one of the two chambers of the hydraulic cylinder (or cylinders) employed to control the positioning of the end element. While the statuses of the first pair of valves are switched, each of the second pair of valves that control the providing of hydraulic fluid to the other of the two chambers of the hydraulic cylinder is maintained in a closed position such that hydraulic fluid cannot be provided to that cylinder chamber from or to the pump or the tank.

By selecting the load-bearing chamber as the chamber with respect to which hydraulic fluid flow is restricted, the end element can be prevented from experiencing any substantial movement due to the force of gravity or other outside forces, including the force of the material through which the end element is attempting to move. Although the flow of hydraulic fluid to the other chamber is switched by the first pair of valves, that chamber does not provide force to the end element for counteracting the outside forces being experienced by the end element, and consequently the switching of the valves has only the relatively minor vibrational impact upon the positioning of the end element. Additionally, the present inventors have discovered that the switching of the first pair of valves can be controlled automatically in response to a single command provided from the operator, and thus requires little manual effort or control.

In another embodiment of the invention, the inventors have discovered that it is possible to cause vibration to occur in a bucket or other end element and at the same time impart motion of the element in a particular direction in a consistent manner. The combined vibration and overall motion is produced by repeatedly switching the positions/statuses of the two pairs of valves that control the flow of hydraulic fluid to and from the two chambers of the hydraulic cylinder (or cylinders). The statuses of the valves are varied in a complementary manner so that, when the first pair of valves are switched so that one cylinder chamber is coupled to the tank, the other pair of valves are switched so that the other cylinder chamber is coupled to the pump. By repeatedly alternating the statuses of the valves, vibration is produced. Further, by switching the valves so that one of the chambers of the cylinder tends to be coupled to the pump for a greater amount of time than the other chamber of the cylinder, overall motion of the end element in a particular direction can be produced.

In particular, the present invention relates to an apparatus for creating vibration of an appendage of a work vehicle. The apparatus includes a hydraulic cylinder coupled between a first portion of the work vehicle and the appendage and including a first chamber, a second chamber, and a piston, where movement of the piston results in corresponding movement of the appendage with respect to the first portion of the work vehicle. The apparatus further includes a valve assembly coupled between the first and second chambers, a pump, and a tank, wherein the valve assembly governs whether hydraulic fluid is provided from the pump to the first and second chambers and to the tank from the first and second chambers. The apparatus additionally includes a control element coupled to the valve assembly, where the control element in response to a command causes a status of at least a first portion of the valve assembly to repeatedly alternate with time so that the hydraulic fluid is alternately provided from the pump to the first chamber and provided to the tank from the first chamber, so that vibration occurs at the piston and is in turn provided to the appendage.

The present invention further relates to an apparatus in a work vehicle. The apparatus includes an appendage coupled to a portion of the work vehicle. The apparatus further includes a hydraulic cylinder coupled between the portion of the work vehicle and the appendage and including a load-bearing chamber, a non-load-bearing chamber, and a piston, where movement of the piston results in related movement of the appendage with respect to the portion of the work vehicle. The apparatus additionally includes a flow regulation means for determining whether hydraulic fluid is provided from a hydraulic pressure source to the non-load-bearing chamber, and from the non-load-bearing chamber to a fluid reservoir. The apparatus further includes a control means for controlling the flow regulation means, where the control means is capable of automatically operating in at least one of a first mode in which the appendage is caused to vibrate without significantly moving from an original position, and a second mode in which the appendage is caused to vibrate and also to experience an overall movement in a particular direction.

The present invention additionally relates to a method of creating vibration at an appendage of a work vehicle. The method includes (a) coupling a hydraulic cylinder between a first portion of the work vehicle and the appendage, and (b) coupling a valve assembly between a pump and first and second chambers of the hydraulic cylinder, and between a tank and the first and second chambers. The method additionally includes (c) receiving a command to provide vibration of the appendage, and (d) controlling a first portion of the valve assembly so that hydraulic fluid flows from the pump to the first chamber and a second portion of the valve assembly so that hydraulic fluid at least one of flows from the second chamber to the tank and is prevented from flowing to and from the second chamber. The method further includes (e) controlling the first portion of the valve assembly so that hydraulic fluid flows from the first chamber to the tank and the second portion of the valve assembly so that hydraulic fluid at least one of flows from the pump to the second chamber and continues to be prevented from flowing to and from the second chamber. The method additionally includes (f) repeating (d) and (e) over a period of time so that the vibration is created at the piston and at the appendage.

DETAILED DESCRIPTION OF THE INVENTION

Figure 1:
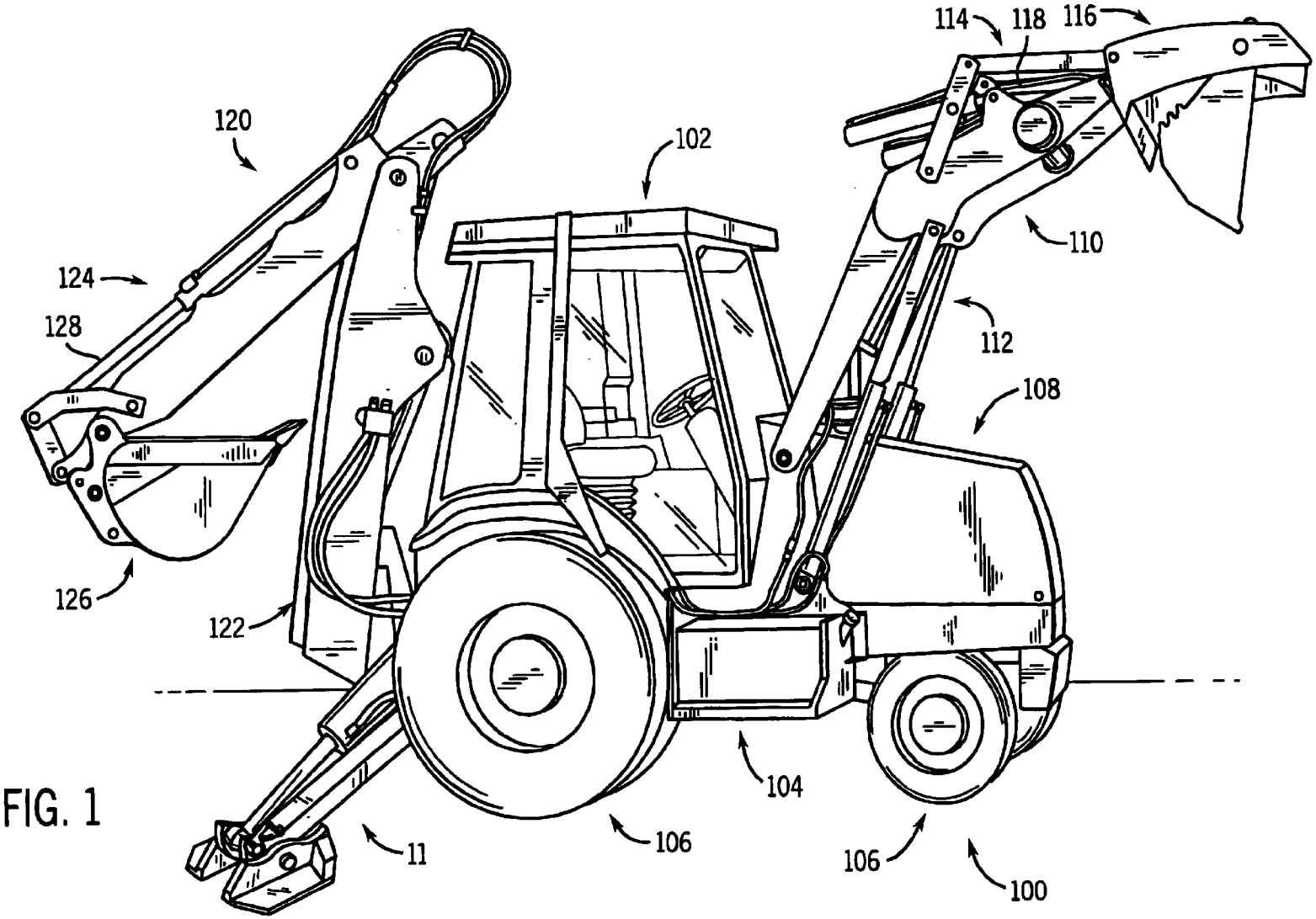
FIG. 1 is an elevation view of an exemplary construction work vehicle having a boom assembly that includes a bucket, on which a new system is implemented for causing vibration of the bucket.

Referring to FIG. 1, an exemplary construction work vehicle shown to be a conventional loader-backhoe 100 includes a cab 102 (wherein an operator is seated and is provided with a variety of instruments and operator controls) mounted on a base 104 and chassis having four wheels 106. Also mounted on the base 104 is an engine or power plant 108 which powers various drive train components and elements of a hydraulic system 200 (which is further discussed with respect to FIG. 2). The loader-backhoe 100 further includes a loader assembly 110 that is mounted at the front end of the vehicle in proximity of the engine 108 and a backhoe assembly 120 that is mounted at the rear end of the vehicle. Stabilizing arms 111 (one is shown) are extendable from the sides of the loader-backhoe 100 adjacent to each of the rear wheels and can provide enhanced support and stability as excavation or like work is performed with the backhoe assembly.

Figure 2:
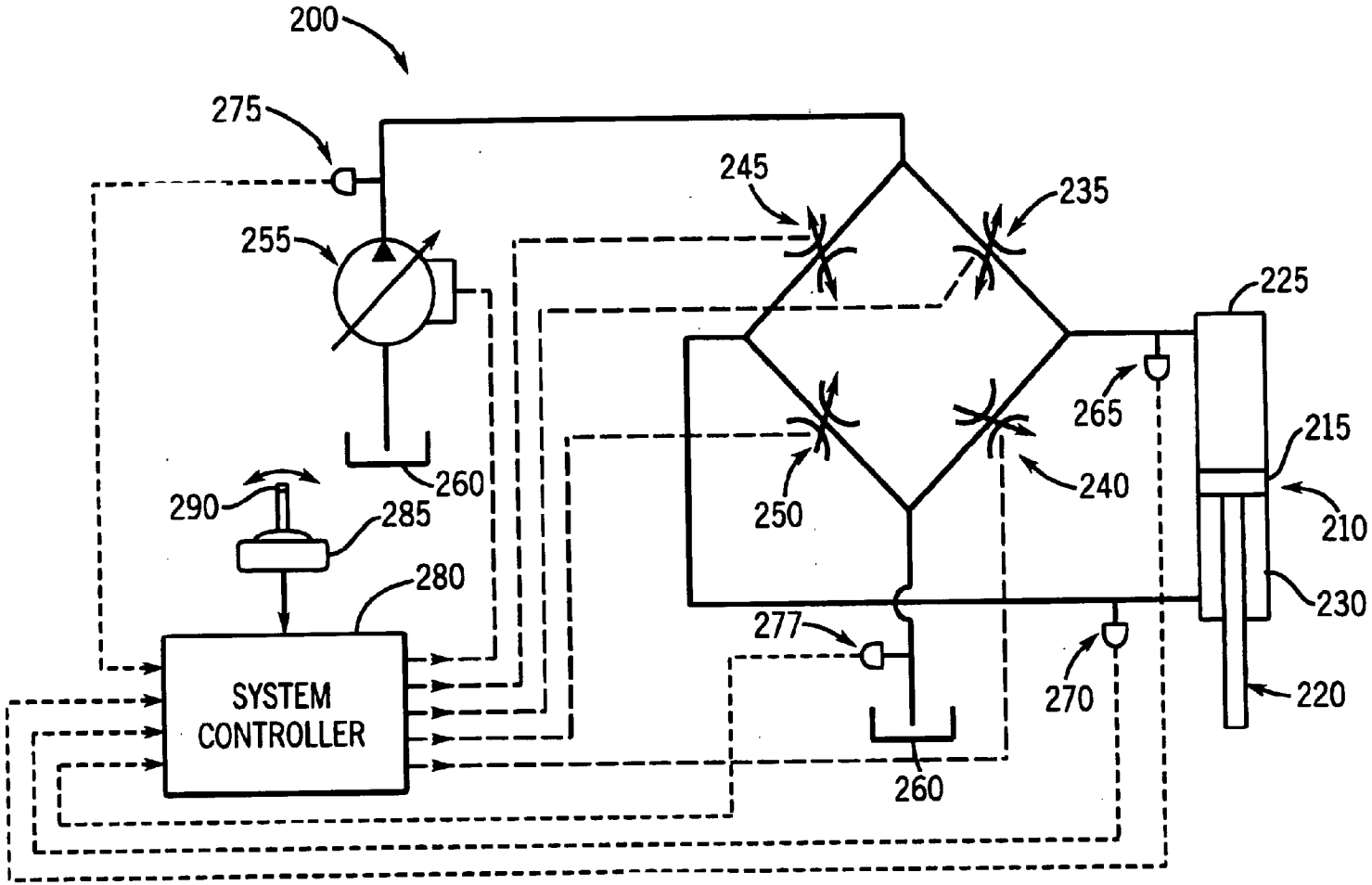
FIG. 2 is a schematic diagram showing exemplary elements of the hydraulic system used to control the positioning of the bucket of the construction work vehicle of FIG. 1 in accordance with the new system.

In particular with reference to the loader assembly 110 and the backhoe assembly 120, which can generally be termed appendages of the loader-backhoe 100 and also can be termed boom assemblies, each of these assemblies is movable with respect to the remainder of the loader-backhoe 100 by way of a hydraulic system (discussed in greater detail with respect to FIG. 2). As shown, the loader assembly 110 includes a boom 112, an arm 114 and a shovel 116, while the backhoe assembly 120 includes a boom 122, an arm 124 and a bucket 126. Each of the booms 112,122, arms 114,124, shovel 116 and bucket 126 are movable with respect to one another and with respect to the remainder of the loader-backhoe 100. Movement of these elements is generated by hydraulic cylinders that provide actuating force, such as hydraulic cylinders 118,128 used to control the positioning of the shovel 116 and the bucket 126, respectively.

In the preferred embodiment, the hydraulic system of the loader-backhoe 100 is in particular able to cause a particular movement of the bucket 126 in which the bucket vibrates at a given rate. The vibration or shaking of the bucket 126 can cause material that is adhering to the bucket to fall off the bucket. In other situations, the vibration or shaking of the bucket 126 can facilitate the piercing by the bucket of material through which the operator is directing the bucket to dig, plow or otherwise move.

Although in the preferred embodiment, it is the bucket 126 that is able to be vibrated or shaken, in alternate embodiments the shovel 116 can also be vibrated, or both the shovel and the bucket can be vibrated. In further alternate embodiments, other or additional portions of the backhoe assembly 120 and/or loader assembly 110 can be vibrated. In still additional alternate embodiments, the work vehicle is a different type of work vehicle other than a loader-backhoe or even a different type of work vehicle than a construction work vehicle, and portions of appendages on such other types of work vehicles can be vibrated.

Turning to FIG. 2, exemplary elements of the hydraulic system 200 of the loader-backhoe 100 employed to control the movement of the bucket 126, including vibration of the bucket, are shown. As shown, the hydraulic system 200 includes a hydraulic cylinder 210 containing a piston 215 that is connected by a rod 220 to the bucket 126. The piston 215 divides the internal cavity of the cylinder 210 into a head chamber 225 and a rod chamber 230, both of which are connected to an array of four bidirectional, proportional control valves 235, 240, 245 and 250 that are electrically operated by solenoids. The first control valve 235 controls the flow of hydraulic fluid from a pump 255 to the head chamber 225. The second bidirectional, proportional control valve 240 regulates the flow of fluid between the head chamber 225 and a tank 260. Similarly, the third proportional control valve 245 governs the flow of hydraulic fluid from the pump 255 to the rod chamber 230, and the fourth proportional valve 250 controls the flow of fluid between the rod chamber 230 and the tank 260.

By appropriately controlling the control valves 235–250, hydraulic fluid from the pump 255 can be applied to one of the cylinder chambers 225 or 230 and exhausted to the tank 260 from the other chamber 230 or 225, respectively. For example, when valves 235 and 250 are opened and valves 240 and 245 are closed, hydraulic fluid from the pump 255 is provided to the head chamber 225 and fluid from the rod chamber 230 flows to the tank 260. Such selective operation of pairs of the four control valves 235–250 drives the piston 215 in one of two directions thereby producing a corresponding movement of the bucket 126 to which the piston is connected.

Additionally, the hydraulic system 200 includes two pressure sensors 265 and 270 that produce electrical signals indicating the pressure within hydraulic lines connected to head and rod chambers 225 and 230, respectively. Another pressure sensor 275 produces an electrical signal denoting the pressure at the outlet of the pump 255. A fourth pressure sensor 277 generates a signal indicative of the pressure in the hydraulic line coupling the control valves 240 and 250 to the tank 260.

As shown, the pump 255 and each of the control valves 235–250 are coupled to and controlled by a system controller 280. The system controller in turn is coupled to a control device such as a joystick 285, which is located within the cab 102 and operable by the operator of the loader-backhoe 100. By moving the joystick 285, the operator can provide a command to the system controller 280 to adjust the position (or velocity) of the bucket 126. The system controller 280 can be any type of control device known in the art, including a computer, a microprocessor, a programmable logic device, or other similar devices.

In addition, a bucket shake button 290 is located on the joystick 285 itself or elsewhere in the cab 102. By pressing the bucket shake button 290, the operator can provide a command to the system controller 280 to enter a vibrating state in which the hydraulic system 200 operates to cause the bucket 126 to vibrate or shake. Upon entering the vibrating state, the system controller 280 remains in the vibrating state for a predetermined period of time (or for a predetermined number of vibrations) and then automatically shuts off.

In alternate embodiments, the system controller 280 remains in the vibrating state until it receives another command from the operator. Also, in alternate embodiments, the bucket shake button 290 can instead be a switch or another type of control device that can be actuated by the operator. Further, in certain alternate embodiments, the system controller 280 is capable of determining when it is necessary to enter the vibrating state automatically without receiving any command from the operator (e.g., based upon signals from one or more sensors).

When operating in the vibrating state, the system controller 280 causes two of the control valves 235–250 to enter a locked state in which both of the two control valves are closed to prevent hydraulic fluid flow through those valves. The two control valves are either the first and second control valves 235,240 used to control fluid flow to and from the head chamber 225, or the third and fourth control valves 245,250 used to control fluid flow to and from the rod chamber 230. The pair of control valves that are closed typically is the pair of control valves controlling fluid flow to that one of the chambers 225,230 that is providing force to the bucket 126 that counteracts an outside force. That is, the pair of control valves that is locked is the pair of control valves governing fluid flow to and from the one of the chambers 225,230 that is load-bearing, as opposed to non-load-bearing. This often depends upon whether the bucket 126 is in a dumped or curled position.

For example, in the case where the bucket 126 is curled when the rod 220 is extended, the force of gravity acting on the bucket (and acting on any contents of the bucket) tends to be forcing the rod to contract. Thus, in such case, the head chamber 225 is the chamber that is load-bearing, that is, the chamber that is providing force to the bucket 126 to counteract an outside force. Likewise, in the case where the bucket 126 is in the dumped position when the rod 220 is retracted, and where the bucket 126 is attempting to dig against clay or soil by scooping inward towards the loader-backhoe 100, again the outside force of the clay or soil resisting the movement of the bucket 126 tends to be forcing the rod to contract. Again, in such case, the head chamber 225 is the load-bearing chamber while the rod chamber 230 is the non-load-bearing chamber, and so it is control valves 235 and 240 that are closed in the locked state to prevent hydraulic flow to or from the head chamber 225.

In different operating positions of the vehicle, it can also be the rod chamber 230 that is the load-bearing chamber, such that the control valves 245,250 are closed in the locked state to prevent oil from entering or leaving the rod chamber 230 and thereby counteract an outside force. Depending upon the circumstance, a dumped position of the bucket 126 can cause the rod chamber 230 to be the load-bearing chamber. Further, the rod chamber 230 can be the load-bearing chamber where the bucket 126 is raised, whenever the rod 220 contracts within the hydraulic cylinder 210. Also, the rod chamber 230 can be the load-bearing chamber in alternate embodiments where the bucket is otherwise configured differently with respect to the backhoe assembly 126. The valves that are closed in the locked state will vary also in embodiments where the hydraulic system 200 is controlling a different element, such as the shovel 116.

In embodiments in which the identity of the load-bearing chamber can vary, signals from the sensors 265, 270, 275 and 277 (or other sensors or other information sources) can be utilized by the system controller 280 to determine which of the chambers 225, 230 is the load-bearing chamber and thus to determine which of the valves 235–250 should be closed in the locked state. In one embodiment, the system controller 280 determines which of the chambers 225, 230 is the load-bearing chamber using the signals from the sensors 265, 270, 275 and 277 by way of the following formula:

$$L=R(P_a-P_r/2)+(P_r/2-P_b) \quad (1)$$

where L is the load status representative of the load, $P_a$ is the pressure within the head chamber 225 of the cylinder 210 as measured by the sensor 265, $P_b$ is the pressure within the rod chamber 230 of the cylinder as measured by the sensor 270, $P_r$ is the return pressure as measured by the sensor 277, and R is the cylinder area ratio defined as the head-side area of the cylinder to the rod-side area. The return pressure is typically measured at or near the control valves 240 and 250, although it can be measured at other nominal locations (having a pressure other than that of the tank) in other embodiments. R is always greater than or equal to one since the area of the rod-side within the cylinder is always less than the area of the head-side. Where $P_r$ is zero (or in embodiments where it can be assumed as zero), the load status L equals $R*P_a-P_b$.

Using equation (1), the value of L is indicative of whether it is the head side or the rod side of the cylinder 210 that is load-bearing. In particular, if L>0 then the head-side of the cylinder 210 is load-bearing, while if L<0 then the rod-side of the cylinder is load-bearing. Typically, the values used for $P_a$, $P_b$, and $P_r$ are measured by the sensors 265,270 and 277, respectively, just prior to (or at the time of) beginning vibration. Thus, based upon these measurements and equation (1), the system controller 280 is able to determine which of the pairs of valves 245,250 or 235,240 should be switched and which of the pairs of valves should be locked. If L=0, then neither side of the cylinder is the load-bearing side, and so either pair of valves can be selected to be switched or locked.

In alternate embodiments, one or more load cells could be employed to measure the forces applied to the rod 220 of the cylinder, instead of measuring the head-side and rod-side pressures. In such embodiments, equation (1) could be modified to:

$$L=-F_x/A_b-R(P_r/2)+(P_r/2) \quad (2)$$

where $F_x$ is the force sensed by the load cell, and $A_b$ is the rod side area.

By closing the pair of control valves that govern the flow of hydraulic fluid to the load-bearing chamber, the hydraulic system 200 prevents unintended lowering of the bucket 126 due to gravity during the vibrating state, and/or unintended movement of the bucket away from the material through which the operator is directing the bucket to dig, plow or otherwise move. Because the control valves that are coupled to the load-bearing chamber are closed, the remaining pair of control valves coupled to the non-load-bearing chamber can still be switched in their statuses without affecting the ability of the hydraulic system 200 to counteract the outside forces being experienced by the bucket 126.

Therefore, the control valves coupled to the non-load-bearing chamber can be repeatedly opened and closed in order to create vibration of the bucket 126. In the case where the head chamber 225 is the load-bearing chamber and the control valves 235 and 240 are closed in the locked state when the system controller 280 has entered the vibrating state, the system controller 280 further controls the remaining control valves 245,250 to repeatedly alternate in their statuses at a particular frequency (or frequencies). In the case where the rod chamber 230 is the load-bearing chamber, the system controller 280 controls the control valves 235, 240 to alternate.

In one embodiment, more specifically, the system controller 280 operates as follows to alternate the statuses of the control valves 245,250 in the case where the head chamber 225 is the load-bearing chamber. At a first time, the system controller 280 causes the third control valve 245 to be opened such that hydraulic fluid pressure from the pump 255 is applied to the rod chamber 230, and causes the fourth control valve 250 to be closed such that hydraulic fluid cannot flow from the rod chamber to the tank 260. Then, at a second time, the system controller 280 causes the third control valve 245 to be closed such that no hydraulic fluid pressure is provided from the pump 255, and the fourth control valve 250 is opened such that hydraulic fluid can flow to the tank 260. The system controller 280 then continues to alternate the respective statuses of the two valves until the system controller leaves the vibrating state.

The alternation of the statuses of the valves, and consequent alternation of the hydraulic fluid pressure provided to the non-load-bearing chamber, causes pressure within that chamber to alternately vary between relative high and low levels. Because the fluid within the load-bearing chamber can at least partly act as a spring, the piston 215 and consequently the rod 220 and the bucket 126 therefore experience vibration. The degree of vibration that is experienced can vary depending upon a variety of factors, including the frequency of alternation of the hydraulic fluid pressure, the amplitude or pump outlet pressure, the type of fluid within the load-bearing chamber and the hydraulic capacitance within the hydraulic lines.

In the preferred embodiment, the frequency of alternation is predetermined to be in the range of 5–10 Hertz, preferably 5 Hertz. However, the predetermined frequency can be different in alternate embodiments, and in certain alternate embodiments the frequency can vary with time or in response to operator commands. Nevertheless, if too high of a frequency is used, the bucket will not shake to that great of an extent. In particular, the desired frequency can depend upon a variety of factors including the mass of the bucket, cylinder size, valve responsiveness, inertia, the amount of hydraulic hose and resulting hydraulic capacitance. In one embodiment, the pump outlet pressure is in the range of 200 to 250 bar. The hydraulic capacitance does not limit the amount of vibration as much as in conventional vibration mechanisms since only the supply line and return line capacitances are in the circuit at any given time.

The duty cycle of the vibration, e.g., the relative proportion of time at which the pump is coupled to the non-load-bearing chamber versus the proportion of time at which the non-load-bearing chamber is coupled to the tank, can also be varied. Because the controlling valves governing fluid flow to the load-bearing chamber are both closed, a duty cycle whereby the proportion of time that the pump is coupled to the non-load-bearing chamber exceeds the proportion of time that the non-load-bearing chamber is coupled to the tank (or vice-versa) does not result in any movement of the bucket (other than vibration). By maintaining a particular duty cycle, a desired time-average hydraulic pressure can be maintained within the non-load-bearing chamber.

Also, as further described with reference to FIG. 3, the control valves governing coupling of the non-load-bearing chamber to the pump and tank need not be alternated directly between only those two states. Rather, in certain embodiments, the control valves can be alternated so that, in between the states in which the non-load-bearing chamber is coupled to the pump and to the tank, respectively, the control valves are both closed so that the non-load-bearing chamber (like the load-bearing chamber) is decoupled from both the pump and the tank. Such an embodiment can be employed in order to avoid direct coupling of the pump to the tank at the times when the non-load-bearing chamber is being coupled and decoupled from the tank and pump.

Although the above-described operation involves locking the pair of control valves that govern fluid flow to and from the load-bearing chamber, in alternate embodiments it is still possible to lock the pair of control valves that govern fluid flow to and from the non-load-bearing chamber (and alternate the statuses of the other two control valves governing fluid flow to and from the load-bearing chamber). Such alternate embodiments are particularly possible where cavitation is not a significant problem. Because it is possible, in some of these embodiments, to obtain the same desired vibration of the bucket 126 (without changes in the bucket's nominal position) regardless of whether it is the control valves to the load-bearing chamber or the non-load-bearing chamber that are locked, it is not necessary in such embodiments to determine which of the chambers is in fact the load-bearing chamber.

The above-described operation produces vibration of the bucket 126 while maintaining the bucket's original or nominal position. However, as discussed above, there are also times at which it is desired for the bucket 126 to move in a particular direction rather than stay in its nominal position.

In accordance with a preferred embodiment of the invention, the system controller 280 is able to operate in both the above-described mode, in which the bucket is vibrated but does not move from its original position, and a second mode, in which the bucket both vibrates and moves. The two modes can be named, respectively, the "neutral bucket shake" (or "shake and rap") mode and the "bucket vibrate" mode. In alternate embodiments, the system controller 280 is only able to operate in one or the other of these modes, that is, the system is only able to vibrate the bucket while maintaining its original position or vibrate the bucket with overall movement, but not both.

An operator's desire for the bucket 126 to move in a particular direction while the bucket vibrates can be indicated by having the operator move the joystick 285 in a particular direction while the button 290 is pressed. In the preferred embodiment, in which the system controller 280 is able to operate in both the neutral bucket shake and bucket vibrate modes, the system controller determines which mode has been selected based upon whether the joystick 285 actually has a non-zero position when the button 290 is pressed. If the joystick 285 has such a non-zero position (and the bucket shake button 290 has been pressed), then it is known that the bucket vibrate mode has been selected; otherwise, the neutral bucket shake mode has been selected by the pressing of the bucket shake button 290.

If a command is received to enter the bucket vibrate mode, the system controller 280 operates in a different manner than that described above with respect to the neutral bucket shake mode. Instead of locking two of the valves corresponding to one side of the cylinder 210 in place, the system controller 280 alternates the two pairs of valves 245,250 and 235,240. That is, at certain times, the head chamber 225 of the cylinder 210 is coupled to the pump 255 while the rod chamber 230 is coupled to the tank 260 and, at other times, the head chamber is coupled to the tank while the rod chamber is coupled to the pump. For example, at a first time, the first valve 235 couples the head chamber 225 to the pump 255, the second and third valves 240, 245 are closed, and the fourth valve 250 couples the rod chamber 230 to the tank 260, while at a second time, the first valve 235 is closed, the second valve couples the head chamber to the tank, the third valve couples the rod chamber to the pump, and the fourth valve is closed. This sequence then repeats itself.

In order that the bucket 126 actually experience overall movement in a direction away from its original position, the time average force applied to the head side of the piston 215 should vary from the time average force applied to the rod side of the piston 215, after accounting for the forces applied by the load. For example, in a case where no load is being placed on the bucket 126, and assuming it is desired to extend the bucket outward towards a dumped position, the time average force applied to the rod side of the piston 215 should exceed the time average force applied to the head side of the piston. However, in a case where a load is being placed on the bucket 126, and the load already is tending to dump the bucket, it may be possible to obtain the desired movement of the bucket even when the time average force applied to the rod side of the piston 215 equals the time average force applied to head side of the piston.

Assuming that the pressures associated with the pump 255 and the tank 260 remain constant, application of the appropriate time average forces to the head and rod sides of the piston 215 depends upon controlling the relative proportion of time during each cycle of alternation that the head chamber 225 is coupled to the pump 255 (and the rod chamber 230 is coupled to the tank 260) instead of the rod chamber 230 being coupled to the pump (and the head chamber being coupled to the tank). The relative proportion of time in which the head chamber 225 is coupled to the pump 255 instead of the rod chamber does not exactly correlate with the relative time average forces applied to the head and rod sides of the piston 215 since the effective area of the head side is somewhat larger than that of the rod side. However, generally speaking (and assuming that there is no particular load acting on the bucket 126), if the head chamber 225 is coupled to the pump 255 for a greater amount of time during each cycle of alternation than the rod chamber 230, then the bucket 126 will tend to experience overall movement corresponding to extension of the rod, e.g., curling of the bucket. Of course, assuming that there are particular loads placed upon the bucket 126, the relative amounts of time that the head chamber 225 and rod chamber 230 are coupled to the pump instead of the tank could potentially be the same and still produce overall movement of the bucket.

The relative proportions of time during which the head side of the piston 215 is coupled to the pump 255 (and the rod side of the piston is coupled to the tank 260) instead of the rod side of the piston being coupled to the pump (and the head side of the piston being coupled to the tank) can be varied to allow for faster or slower overall motion away from the original position of the bucket 126. In one embodiment, the position of the joystick can be varied to modify the duty cycles of the relative amounts of time that the head chamber 225 and rod chamber 230 are coupled to the pump instead of the tank, and thereby affect the velocity of movement of the bucket 126. Also, there can be periods of time during each cycle of alternation in which one or both chambers 225,230 are locked (e.g., to avoid direct hydraulic coupling of the pump to the tank).

Figure 3:
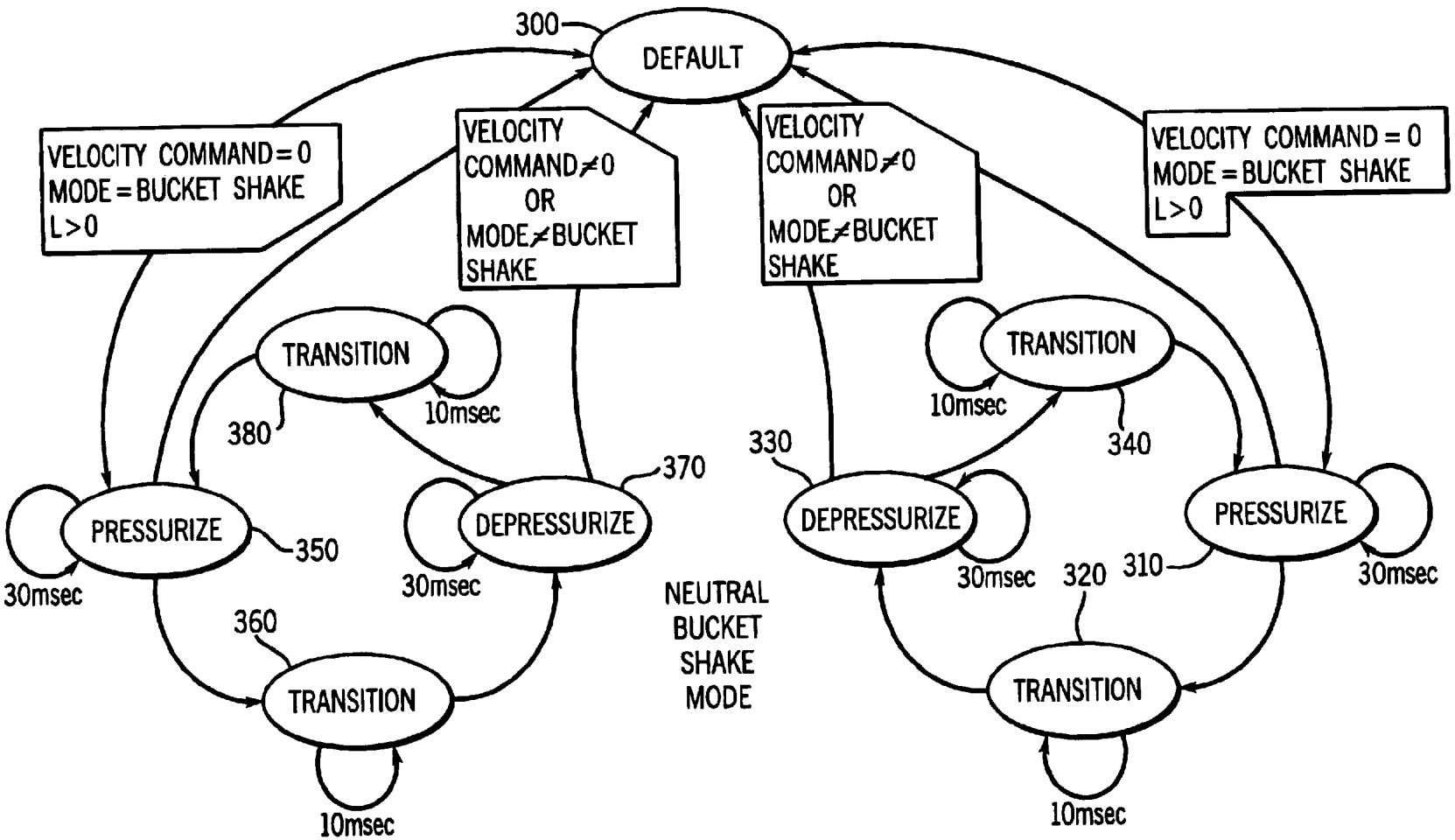
FIGS. 3 and 4 are exemplary state diagrams showing operation of a system controller to control vibration and movement of the bucket in neutral bucket shake and bucket vibrate modes, respectively.
Figure 4:
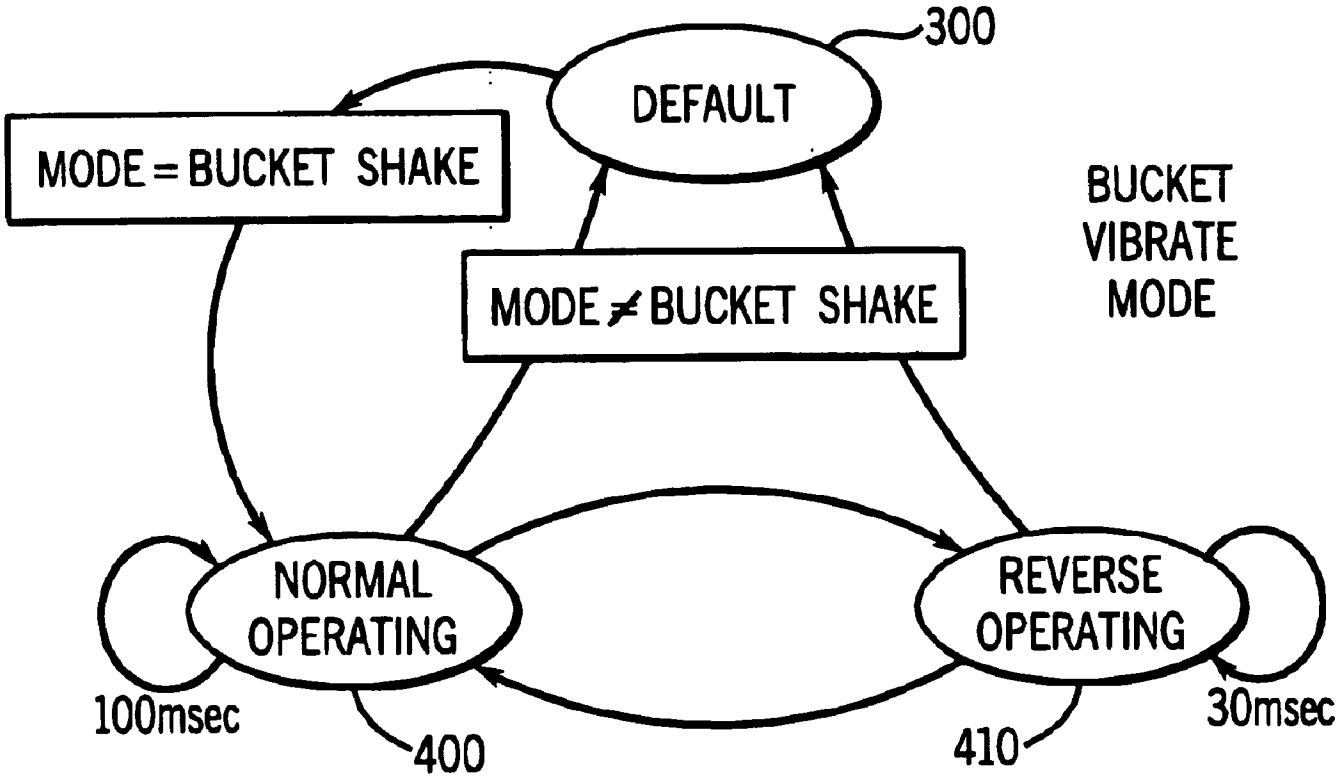

Turning to FIGS. 3 and 4, exemplary state diagrams are provided to show operation of the system controller 280 in the neutral bucket shake mode and the bucket vibrate mode, respectively. With respect to FIG. 3 regarding the neutral bucket shake mode, the system controller 280 operates in nine states 300–380. Before a command is received from the operator, the system controller is in a default state 300 in which the system is operating as usual without vibration (this can also be termed a normal mode of operation). Upon receiving a command to enter one of the vibrating modes, provided by the operator by pressing the button 290, the system controller determines whether the joystick 285 is at a non-zero position (indicating a non-zero desired velocity). If it is at a non-zero position, the bucket vibrate mode has been selected, and the system controller 280 proceeds to the states of FIG. 4.

However, if the joystick is in a zero position, the neutral bucket shake mode has been selected and so the system controller 280 proceeds to either state 310 or state 350 depending upon whether the load status L is less than or greater than zero, respectively. If L>0, indicating that the head-side of the cylinder 210 is load-bearing, the system controller proceeds to state 350, in which pump 255 is coupled to the rod chamber 230 for 30 msec. Following this period of time, the controller then proceeds to state 360, which is a transition state in which the rod chamber 230 is closed off from either the pump 255 or the tank 260, for 10 msec.

Next, the controller proceeds to state 370, in which the tank 260 is coupled to the rod chamber 230 for 30 msec. Then the controller 280 proceeds to another transition state 380, in which the rod chamber is again closed off for 10 msec, after which the controller returns to state 350. The controller 280 continues to cycle through the states 350–380 until such time as the controller receives a command to leave the present mode (e.g., because the joystick 285 has been set to a non-zero position), because the load-bearing chamber is changed, because of the expiration of a time-out period, because the button 290 is released, or for another reason. The controller 280 then returns (from one of the states 350 or 370) to the default state 300.

If the neutral bucket shake mode has been selected but the load status L<0, then the controller 280 proceeds through states 310–340 in the same manner as through states 350–380, the only difference being that the head chamber 225 is successively pressurized and depressurized. Depending upon the embodiment, the lengths of times in which the controller 280 pressurizes, depressurizes, or transitions between pressurization and depressurization can vary relative to one another or in terms of their absolute lengths. In the embodiment of FIG. 3, the overall time for cycling through states 310–340 or 350–380 is 80 msec, such that an approximately 12 Hz vibration is created. The transition states 320,340,360 and 380 in this embodiment decouple the non-load-bearing chamber from both pump and the tank for periods of time in between the times at which either the pump or the tank are coupled to that chamber, in order to avoid direct coupling of the pump to the tank.

If the button 290 is pressed and the joystick 285 is in a non-zero position, the bucket vibrate mode of operation has been selected by the operator. Consequently, the system controller 280 proceeds from the default state 300 to a normal operating state 400 (not to be confused with the normal mode associated with the default state 300), and then to a reverse operating state 410, as shown in FIG. 4. The controller 280 then cycles back and forth between states 400 and 410 until such time as the operator commands a different mode of operation, a time-out period has ended, or some other criterion has been met (e.g., a pressure sensor detects that the bucket 126 has encountered an strong resistance). In the normal operating state 400, the system controller 280 causes the bucket 126 to move in one direction by coupling the head chamber 225 to the pump 255 and the rod chamber 230 to the tank 260. In the reverse operating state, the system controller 280 causes the bucket 126 to move in the opposite direction by coupling the head chamber 225 to the tank 260 and the rod chamber 230 to the pump 255.

As shown in FIG. 4, in the present embodiment, the system controller 280 remains in the states 400 and 410 for differing amounts of time, namely, 100 msec and 30 msec, respectively, such that the duty cycle of is approximately 23% in the reverse direction. Consequently, the mean force experienced in the forward direction is greater than the mean force in the reverse direction, and so overall the forces exerted tend to curl the bucket 126. If the time periods for the two states were reversed, the forces would tend to move the bucket 126 toward a dumped position.

The speed with which the bucket 126 moves depends upon the relative magnitudes of the two times (and the resulting mean pressures that are provided to the chambers of the cylinder). The speed of vibration depends upon the frequency at which the system controller 280 cycles through the states 400 and 410. In the present embodiment, the total time for cycling through the states once is 130 msec, such that the frequency of vibration is 8 Hz. The relative and absolute magnitudes of the times at states 400 and 410 can be varied and, in particular, the relative magnitudes of the times will typically vary in dependence upon the particular velocity commanded by the operator.

In certain embodiments, there may additionally be states in between the states 400 and 410 in which no hydraulic flow is allowed between either of the chambers and the tank and pump, similar to the states 320,340,360 and 380. Also, in various embodiments, the applied hydraulic pressures, frequencies of alternation and duty cycles can be varied depending upon a variety of inputs including but not limited to time, the actual load experienced by the load-bearing chamber, the boom pressure (as an estimate of load), force calculations, load calculations or user setpoints.

While the foregoing specification illustrates and describes the preferred embodiments of this invention, it is to be understood that the invention is not limited to the precise construction herein disclosed. The invention can be embodied in other specific forms without departing from the spirit or essential attributes. For example, while a poppet valve is shown in FIG. 2, the invention could also be implemented using various other types of valves (e.g., spool valves). Accordingly, reference should be made to the following claims, rather than to the foregoing specification, as indicating the scope of the invention.

What is claimed is:

1. An apparatus for creating vibration of an appendage of a work vehicle, the apparatus comprising:

a hydraulic cylinder coupled between a first portion of the work vehicle and the appendage and including a first chamber, a second chamber, and a piston, wherein movement of the piston results in corresponding movement of the appendage with respect to the first portion of the work vehicle;

a valve assembly coupled between the first and second chambers, a pump, and a tank, wherein the valve assembly governs whether hydraulic fluid is provided from the pump to the first and second chambers and to the tank from the first and second chambers; and a control element coupled to the valve assembly, wherein the control element in response to a command causes a status of at least a first portion of the valve assembly to repeatedly alternate with time so that the hydraulic fluid is alternately provided from the pump to the first chamber and provided to the tank from the first chamber, so that vibration occurs at the piston and is in turn provided to the appendage.

2. The apparatus of claim 1, wherein the control element in response to the command causes a second portion of the valve assembly to enter a locked state in which hydraulic fluid is prevented from flowing to and from the second chamber.

3. The apparatus of claim 2, wherein the first portion of the valve assembly includes a first valve coupled between the pump and the first chamber and a second valve coupled between the tank and the first chamber, and wherein the second portion of the valve assembly includes a third valve coupled between the pump and the second chamber and a fourth valve coupled between the tank and the second chamber.

4. The apparatus of claim 3, wherein in the locked state the third valve and the fourth valve are both in closed positions.

5. The apparatus of claim 4 wherein, while the second portion of the valve assembly is in the locked state, at a first series of times the first valve is open and the second valve is closed and at a second series of times the first valve is closed and the second valve is open, wherein times of the first series alternate with times of the second series.

6. The apparatus of claim 5, wherein times of the first series alternate with times of the second series at a frequency within a range of 5–15 Hertz.

7. The apparatus of claim 6, wherein the vibration that is provided to the appendage also is within the range of 5–15 Hertz, and wherein in between the times of the first series and the second series are periods of time in which the first portion of the valve assembly also enters a locked state.

8. The apparatus of claim 2, wherein the second chamber is a load-bearing chamber capable of providing force to the piston that in turn results in a force at the appendage capable of resisting an outside force.

9. The apparatus of claim 1, wherein the first chamber is a non-load-bearing chamber, and wherein a determination that the first chamber is the non-load-bearing chamber is made based upon a quantity L, wherein L is defined as follows: $L=R\ (P_a-P_r/2)+(P_r/2-P_b)$.

10. The apparatus of claim 8, wherein the outside force is one of a force of gravity and a force of a material into which the appendage is moving.

11. The apparatus of claim 1, wherein the work vehicle is a construction work vehicle that is a loader-backhoe.

12. The apparatus of claim 1, wherein the appendage is a bucket, and wherein the bucket is coupled to an arm, which in turn is coupled between the bucket and a boom, which in turn is coupled between the arm and the first portion of the work vehicle, wherein the bucket, arm, and boom form a boom assembly, and wherein the hydraulic cylinder is coupled between the bucket and the arm.

13. The apparatus of claim 1, wherein the appendage is a shovel of a front end loader, wherein the hydraulic cylinder is coupled between a left arm portion of the front end loader and a left side of the shovel, and wherein a second hydraulic cylinder is coupled between a right arm portion of the front end loader and a right side of the shovel.

14. The apparatus of claim 1, wherein the control element in response to the command causes both the status of the first portion of the valve assembly and the status of a second portion of the valve assembly to repeatedly alternate with time so that, at a first series of times, hydraulic fluid is provided from the pump to the first chamber and from the second chamber to the tank and, at a second series of times, hydraulic fluid is provided from the first chamber to the tank and from the pump to the second chamber.

15. The apparatus of claim 14, wherein each of the first series of times has a first length, and each of the second series of times has a second length, and wherein the relative sizes of the first and second lengths depend upon the command.

16. The apparatus of claim 1, wherein the control element is capable of receiving a plurality of different commands, in response to which the control element enters a plurality of different modes of operation.

17. An apparatus in a work vehicle, the apparatus comprising:

an appendage coupled to a portion of the work vehicle;

a hydraulic cylinder coupled between the portion of the work vehicle and the appendage and including a load-bearing chamber, a non-load-bearing chamber, and a piston, wherein movement of the piston results in related movement of the appendage with respect to the portion of the work vehicle; and a flow regulation means for determining whether hydraulic fluid is provided from a hydraulic pressure source to the non-load-bearing chamber, and from the non-load-bearing chamber to a fluid reservoir, and a control means for controlling the flow regulation means, wherein the control means is capable of automatically operating in at least one of a first mode in which the appendage is caused to vibrate without significantly moving from an original position, and a second mode in which the appendage is caused to vibrate and also to experience an overall movement in a particular direction.

18. The apparatus of claim 17, wherein the control means also determines which of first and second chambers of the cylinder is the non-load-bearing chamber.

19. A method of creating vibration at an appendage of a work vehicle, the method comprising:

(a) providing a hydraulic cylinder between a first portion of the work vehicle and the appendage;

(b) providing a valve assembly between a pump and first and second chambers of the hydraulic cylinder, and between a tank and the first and second chambers;

(c) receiving a command to provide vibration of the appendage;

(d) controlling a first portion of the valve assembly so that hydraulic fluid flows from the pump to the first chamber and a second portion of the valve assembly so that hydraulic fluid at least one of flows from the second chamber to the tank and is prevented from flowing to and from the second chamber;

(e) controlling the first portion of the valve assembly so that hydraulic fluid is capable of flowing from the first chamber to the tank and the second portion of the valve assembly so that hydraulic fluid is prevented from flowing to and from the second chamber; and (f) repeating (d) and (e) over a period of time so that the vibration is created at the piston and at the appendage.

20. The method of claim 19, wherein the command is provided by the activating of a user input device located in a cab of the work vehicle.

21. The method of claim 19, wherein prior to entering a special mode, the valve assembly is controlled by way of manual commands, and while in the special mode the valve assembly is controlled automatically.

22. The method of claim 18, wherein the appendage is at least one of a bucket and a shovel, the work vehicle is a construction work vehicle, and wherein the vibration occurs at a frequency within a range of 5–15 Hertz.

23. A system for generating vibration of an appendage of a work vehicle, the system comprising:

a cylinder coupled between a first portion of the work vehicle and the appendage and including a first chamber, a second chamber, and a piston, wherein movement of the piston results in corresponding movement of the appendage with respect to the first portion of the work vehicle;

a valve assembly coupled between the first and second chambers, a pump, and a tank, wherein the valve assembly governs whether hydraulic fluid is provided from the pump to the first and second chambers and to the tank from the first and second chambers; and a control element coupled to the valve assembly, wherein the control element in response to a command causes a status of a first portion of the valve assembly to repeatedly alternate with time so that the hydraulic fluid is alternately provided from the pump to the first chamber and provided to the tank from the first chamber, so that vibration occurs at the piston and is in turn provided to the appendage, wherein the control element in response to the command causes a second portion of the valve assembly to enter a locked state in which hydraulic fluid is prevented from flowing to and from the second chamber.

24. A system for generating vibration of an appendage of a work vehicle, the system comprising:

a cylinder coupled between a first portion of the work vehicle and the appendage and including a first chamber, a second chamber, and a piston, wherein movement of the piston results in corresponding movement of the appendage with respect to the first portion of the work vehicle;

a valve assembly coupled between the first and second chambers, a pump, and a tank, wherein the valve assembly governs whether hydraulic fluid is provided from the pump to the first and second chambers and to the tank from the first and second chambers; and a control element coupled to the valve assembly, wherein the control element in response to a command causes both the status of a first portion of the valve assembly and the status of a second portion of the valve assembly to repeatedly alternate so that, at a first series of times, hydraulic fluid is provided from the pump to the first chamber and from the second chamber to the tank and, at a second series of times, hydraulic fluid is provided from the first chamber to the tank and from the pump to the second chamber, the times of the first and second series alternating with one another in time, and wherein the times of the first series differ in length from the times of the second series.

25. The system of claim 24, wherein due to the differing lengths of the times of the first and second series, the piston experiences both the vibration and an overall movement in a first direction.

26. A method of creating vibration at an appendage of a work vehicle, the method comprising:

(a) providing a hydraulic cylinder between a first portion of the work vehicle and the appendage;

(b) providing a valve assembly between a pump and first and second chambers of the hydraulic cylinder, and between a tank and the first and second chambers;

(c) receiving a command to provide vibration of the appendage;

(d) controlling first and second portions of the valve assembly so that during a first time period hydraulic fluid flows from the pump to the first chamber and from the second chamber to the tank;

(e) controlling the first and second portions of the valve assembly so that during a second time period hydraulic fluid flows from the first chamber to the tank and the from the pump to the second chamber; and (f) repeating (d) and (e) so that the vibration is experienced by a piston of the hydraulic cylinder and at the appendage linked to the piston, wherein the first and second time periods are of unequal length so that the piston and the appendage also experience an overall movement in a first direction.

* * * * *